US006564559B2

(12) United States Patent
Hozumi et al.

(10) Patent No.: US 6,564,559 B2
(45) Date of Patent: May 20, 2003

(54) METHOD AND APPARATUS FOR FREEZING SUPERCOOLED LIQUID AS WELL AS METHOD AND SYSTEM FOR CIRCULATING OR FLOWING PARTIALLY FROZEN LIQUID

(75) Inventors: Tsutomu Hozumi, Machida (JP); Akio Saito, Yokohama (JP); Seiji Ohkawa, Yokohama (JP); Hiroyuki Kumano, Tokyo (JP)

(73) Assignee: Tokyo Institute of Technology, Tokyo (JP)

( * ) Notice: Subject to any disclaimer, the term of this patent is extended or adjusted under 35 U.S.C. 154(b) by 0 days.

(21) Appl. No.: 10/133,351

(22) Filed: Apr. 29, 2002

(65) Prior Publication Data

US 2002/0194855 A1 Dec. 26, 2002

(30) Foreign Application Priority Data

May 7, 2001 (JP) ..... 2001-136161

(51) Int. Cl.[7] ..... F25C 1/18
(52) U.S. Cl. ..... 62/68; 62/340
(58) Field of Search ..... 62/68, 66, 340

(56) References Cited

U.S. PATENT DOCUMENTS 3,224,213 A * 12/1965 Hoyt, Jr. ..... 62/68
4,184,339 A * 1/1980 Wessa ..... 62/68
4,686,833 A * 8/1987 Hino et al. ..... 62/68
5,845,513 A * 12/1998 Fornasari ..... 62/353

* cited by examiner

*Primary Examiner*—William E. Tapolcai
(74) *Attorney, Agent, or Firm*—Oliff & Berridge, PLC

(57) ABSTRACT

A method for freezing a supercooled liquid, includes the steps of forming a liquid phase of a supercooled liquid and a gas phase adjacent to the liquid phase in a container, vibrating a gas-liquid interface formed by said liquid phase and the gas phase by applying vibration upon the gas-liquid interface and/or a vicinity thereof along the gas-liquid interface, forming splashed waves of the supercooled liquid, scattering liquid drops of the supercooled liquid, crashing the liquid drops upon a portion of an inner wall of the container where the gas phase is located, mixing resulting liquid drops and bubbles into the supercooled liquid through the gas-liquid interface, subjecting said bubbles mixed in the supercooled liquid to expansion, compression, disruption, clustering and disappearance, thereby vigorously oscillating the gas-liquid interface and freezing the supercooled liquid.

8 Claims, 6 Drawing Sheets

METHOD AND APPARATUS FOR FREEZING SUPERCOOLED LIQUID AS WELL AS METHOD AND SYSTEM FOR CIRCULATING OR FLOWING PARTIALLY FROZEN LIQUID

BACKGROUND OF THE INVENTION

1. Field of the Invention

The present invention relates to supercooled liquid-freezing method and apparatus which are used in an ice thermal storage system of a freezing machine, for example and adapted to release the supercooled liquid from a supercooled state through freezing. The invention also relates to a method and a system for circulating or flowing cooled liquid at least a part of which is released from a supercooled state. Particularly, the invention relates to the method and the apparatus for freezing supercooled liquid having a low supercooled degree, which method and apparatus can positively release the supercooled liquid from the supercooled state at an arbitrary point of time and at an arbitrary place. The invention also relates to the method and the system for circulating or flowing the supercooled liquid at least a part of which is released from the supercooled state.

2. Related Art Statement

A method in which flowing supercooled liquid is made to spontaneously fall and impinge upon a plate to freeze it is known as a conventional supercooled state-removing (freezing) technique.

However, since this method requires a sufficient long distance for freezing, an apparatus for this becomes bulky. Further, the supercooled liquid cannot be frozen at any time or any place. In addition, if the supercooled liquid is at a low supercooled degree, it is unfavorably difficult to freeze the liquid.

The present invention is aimed at solving the problems of the prior art apparatuses through discovery of the new supercooled state-removing method and apparatus having a smaller size than the conventional ones and being able to positively release the supercooled liquid from the supercooled state at any time and any place and rapidly freeze the supercooled liquid, even if the supercooled liquid is at such a low supercooled degree as not allowing easy freezing.

SUMMARY OF THE INVENTION

A first aspect of the present invention relates to a method for solidifying a supercooled liquid, comprising the steps of forming a liquid phase of a supercooled liquid and a gas phase adjacent to said liquid phase in a container, vibrating a gas-liquid interface formed by said liquid phase and said gas phase by applying vibration upon the gas-liquid interface and/or a vicinity thereof along the gas-liquid interface, forming splashed waves of the supercooled liquid, scattering liquid drops of the supercooled liquid, crashing the liquid drops upon a portion of an inner wall of said container where the gas phase is located, mixing resulting liquid drops and bubbles into the supercooled liquid through the gas-liquid interface, subjecting said bubbles mixed in the supercooled liquid to expansion, compression, disruption, clustering and disappearance, thereby vigorously oscillating the gas-liquid interface and freezing the supercooled liquid.

A second aspect of the present invention relates to a supercooled liquid-freezing apparatus comprising a container for forming a liquid phase of a supercooled liquid and a gas phase therein, and an oscillator for applying vibration upon a gas-liquid interface formed inside the container between the liquid phase and the gas phase and/or a vicinity thereof along the gas-liquid interface, whereby vibrating the gas-liquid interface by application of vibration with said oscillator, forming splashed waves of the supercooled liquid, scattering liquid drops of the supercooled liquid, crashing the liquid drops upon a portion of an inner wall of said container where the gas phase is located, mixing resulting liquid drops and bubbles into the supercooled liquid through the gas-liquid interface, subjecting said bubbles mixed in the supercooled liquid to expansion, compression, disruption, clustering and disappearance, thereby vigorously oscillating the gas-liquid interface and freezing the supercooled liquid.

According to the first aspect of the present invention, it is preferable that an oscillator is immersed into said liquid phase inside the container, and the vibration is applied upon the gas-liquid interface formed by the liquid phase and the gas phase and/or said vicinity thereof by said oscillator.

According to the second aspect of the present invention, it is preferable that the oscillator comprises an oscillator immersed into said liquid phase inside the container, and the vibration is applied upon the gas-liquid interface formed by the liquid phase and the gas phase and/or said vicinity thereof by said oscillator.

A third aspect of the present invention relates to a method for circulating or flowing a supercooled liquid, comprising the steps of introducing at least part of a circulating or flowing supercooled liquid into a container provided with a supercooled liquid inlet, forming a liquid phase of said supercooled liquid introduced and a gas phase adjacent to said liquid phase in said container, vibrating a gas-liquid interface formed by said liquid phase and said gas phase by applying vibration upon the gas-liquid interface and/or a vicinity thereof along the gas-liquid interface, forming splashed waves of the supercooled liquid, scattering liquid drops of the supercooled liquid, crashing the liquid drops upon a portion of an inner wall of said container where the gas phase is located, mixing resulting liquid drops and bubbles into the supercooled liquid through the gas-liquid interface, subjecting said bubbles mixed in the supercooled liquid to expansion, compression, disruption, clustering and disappearance, thereby vigorously oscillating the gas-liquid interface and freezing the supercooled liquid, returning the supercooled liquid at least a part of which is released from being supercooled into the circulating or flowing supercooled liquid, and circulating or flowing the resultant.

A fourth aspect of the present invention relates to a supercooled liquid-circulating or flowing system comprising means for circulating or flowing a supercooled liquid, a container provided with a supercooled liquid inlet and adapted for receiving at least a part of the circulating or flowing supercooled liquid and forming a liquid phase of a supercooled liquid and a gas phase therein, an oscillator for applying vibration upon a gas-liquid interface formed inside the container between the liquid phase and the gas phase and/or a vicinity thereof along the gas-liquid interface, whereby vibrating the gas-liquid interface by application of vibration with said oscillator, forming splashed waves of the supercooled liquid, scattering liquid drops of the supercooled liquid, crashing the liquid drops upon a portion of an inner wall of said container where the gas phase is located, mixing resulting liquid drops and bubbles into the supercooled liquid through the gas-liquid interface, subjecting said bubbles mixed in the supercooled liquid to expansion, compression, disruption, clustering and disappearance, thereby vigorously oscillating the gas-liquid interface and freezing the supercooled liquid, returning the supercooled liquid at least a part of which is released from being supercooled into the circulating or flowing supercooled liquid, and circulating or flowing said returned supercooled liquid.

According to the present invention, the gas-liquid interface formed by the liquid phase and the gas phase is vibrated by applying vibration upon the gas-liquid interface and/or a vicinity thereof along the gas-liquid interface, splashed waves of the supercooled liquid are formed, liquid drops of the supercooled liquid are scattered, the liquid drops are vigorously crashed upon a portion of an inner wall of said container where the gas phase is located, resulting liquid drops and bubbles are mixed into the supercooled liquid through the gas-liquid interface, said bubbles mixed in the supercooled liquid are subjected to expansion, compression, disruption, clustering and disappearance, and thereby the gas-liquid interface is vigorously oscillated. While the liquid drops and the bubbles are continuously mixed into the supercooled liquid, freezing nuclei are formed in the liquid drops and the supercooled liquid inside the container to freeze the supercooled liquid. The supercooled liquid in the surrounding area can be continuously frozen by discharging the supercooled liquid at least a part of which is released from being supercooled into that outside the container. The supercooled liquid inside the container is converted to a sherbet-like state, for example, after being released from the supercooled state.

With respect to the "liquid drops" to be mixed into the supercooled liquid through the gas-liquid interface in the context of "splashed waves of the supercooled liquid are formed, liquid drops of the supercooled liquid are scattered, the liquid drops are crashed upon a portion of an inner wall of said container where the gas phase is located, resulting liquid drops and bubbles are mixed into the supercooled liquid through the gas-liquid interface", such "liquid drops" which may be partially or entirely frozen upon crashing include "partially or entirely frozen liquid drops".

According to the freezing method and apparatus of the present invention, the supercooled liquid at such a low supercooled state as not allowing easy freezing can be instantly frozen at any time through positively eliminating the supercooled state with the smaller apparatus as compared with the prior art. In addition, since a number of such downsized apparatuses can be easily installed in the supercooled liquid or moved therein, the supercooled liquid can be frozen at any place.

Therefore, when the freezing apparatus according to the present invention is used as a supercooled state-eliminating apparatus for an ice thermal storage system, for example, the freezing load of the freezer can be largely reduced, which can greatly contribute to the energy storage field, the freezing air conditioning field and the environmental field.

In the present invention, when the sealed container is provided with a supercooled liquid inlet and a supercooled liquid outlet which can be opened and closed, and the supercooled liquid inlet and the supercooled liquid outlet are appropriately controlled to be opened or closed, the supercooled liquid can be continuously frozen and discharged. In this case, one opening may be commonly used for two kinds of the supercooled liquid inlet and the supercooled liquid outlet. As a feeder for introducing the supercooled liquid into the container from the outside thereof, any means such as a pump may be used, for example. The supercooled liquid at least a part of which is released from being supercooled may be discharged with any means such as a pump. The container may have supercooled liquid inlet and outlet in the outside supercooled liquid, for example at a bottom portion or a side face thereof. Alternatively, it may be that the container is merely provided with the supercooled liquid inlet and the supercooled liquid outlet, the container is kept still or immersed in the flowing supercooled liquid, and the supercooled liquid is spontaneously introduced into the container without providing any particular supercooled liquid feeder or discharge means.

Further, "vibration" utilized in the present invention is not particularly limited, so long as it is ensured that the gas-liquid interface formed by the liquid phase and the gas phase is vibrated by applying vibration upon the gas-liquid interface and/or a vicinity thereof along the gas-liquid interface, splashed waves of the supercooled liquid are formed, liquid drops of the supercooled liquid are scattered, the liquid drops are crashed upon a portion of an inner wall of said container where the gas phase is located, resulting liquid drops and bubbles are mixed into the supercooled liquid through the gas-liquid interface, said bubbles mixed in the supercooled liquid are subjected to expansion, compression, disruption, clustering and disappearance, thereby the gas-liquid interface is vigorously oscillated and the supercooled liquid is frozen. That is, the vibration may be lateral vibration along the gas-liquid interface or vertical vibration.

According to the present invention, vibrations ranging from a low frequency to a high frequency may be utilized. For example, the low-frequency vibration may include vibrations in a frequency range of 5~10/sec. On the other hand, any high-frequency vibration may be utilized in the present invention, so long as it produces the above-mentioned effects. However, vibrations at a ultrasonic wave range frequency or a near range thereof cannot afford effective vibrations upon the gap-liquid interface, and it is presumed that the temperature of the supercooled liquid rises due to the vibration. Thus, such vibrations are excluded in the present invention.

Any intensity of the vibration is sufficient, so long as it is ensured that the gas-liquid interface is vibrated by continuously applying vibration at a given frequency upon the gas-liquid interface and/or a vicinity thereof along the gas-liquid interface, splashed waves of the supercooled liquid are formed, liquid drops of the supercooled liquid are scattered, the liquid drops are crashed upon a portion of an inner wall of said container where the gas phase is located, resulting liquid drops and bubbles are mixed into the supercooled liquid through the gas-liquid interface, said bubbles mixed in the supercooled liquid are subjected to expansion, compression, disruption, clustering and disappearance, and thereby the gas-liquid interface is vigorously oscillated, during which freezing nuclei are formed in the liquid drops or the supercooled liquid inside the container to sufficiently freeze the supercooled liquid. With respect to the vibration utilized in the present invention, those skilled person in the art can easily set the intensity of the vibration when a given frequency is selected for the vibration. However, if the frequency of the vibration is too low, it is impossible to effectively cause the formation of the splashed waves and scattering of the supercooled liquid drops, so that a sufficient amount of the freezing nuclei are not formed, and the supercooled state of the supercooled liquid is not sufficiently released.

The container is not limited to a container which has a continuous surrounding shape, but a part of the container may be lacking. The container may include opposed planar members having curved shapes and being discontinuously arranged, for example, between which a space is internally so defined that splashed waves of the supercooled liquid are formed in that space by vibration, the supercooled liquid is thereby scattered, and numerous liquid drops are crashed upon a portion of the inner wall of the container where the gas phase is located.

The vibration may include manual vibration, i.e., the container is vibrated by hand. The oscillator may include a reciprocal oscillator, a rotary oscillator, etc. which produce vibration at a given frequency. The oscillator may be any oscillator which is immersed into the liquid phase inside the container and affords vibration at a given frequency upon the gas-liquid interface between the liquid phase and the gas phase and/or the vicinity thereof. The oscillator may be a stirring rod or a so-called stirrer. In that case, vibration is afforded upon the stirring rod or the like, and it is continuously hit upon the inner wall of the container, so that the gas-liquid interface is effectively vigorously vibrated and the clashed waves and the scattered liquid drops can be formed.

The "liquid" used in this application is a concept including not only water but also a solution such as an ethylene glycol aqueous solution.

Furthermore, according to the present invention, a heater may be provided around the supercooled liquid-receiving container. According to such a freezing apparatus, when the container is heated with the heater as the liquid released from the supercooled state owing to the mixing between the gas and the liquid is discharged outside from the container, attachment of ice nuclei upon the inner wall of the container can be prevented without excess heating of the supercooled liquid around the container. This can facilitate the continuous use of the apparatus.

BRIEF DESCRIPTION OF THE DRAWINGS

For a better understanding of the invention, reference is made to the attached drawings, wherein.

DETAILED DESCRIPTION OF THE INVENTION

The present invention will be explained based on specific embodiments with reference to the drawings. The following embodiments are merely illustrated exclusively for merely explaining the invention, but it should not be interpreted that the invention is limited to only the embodiments illustrated.

Figures 1A, 1B:
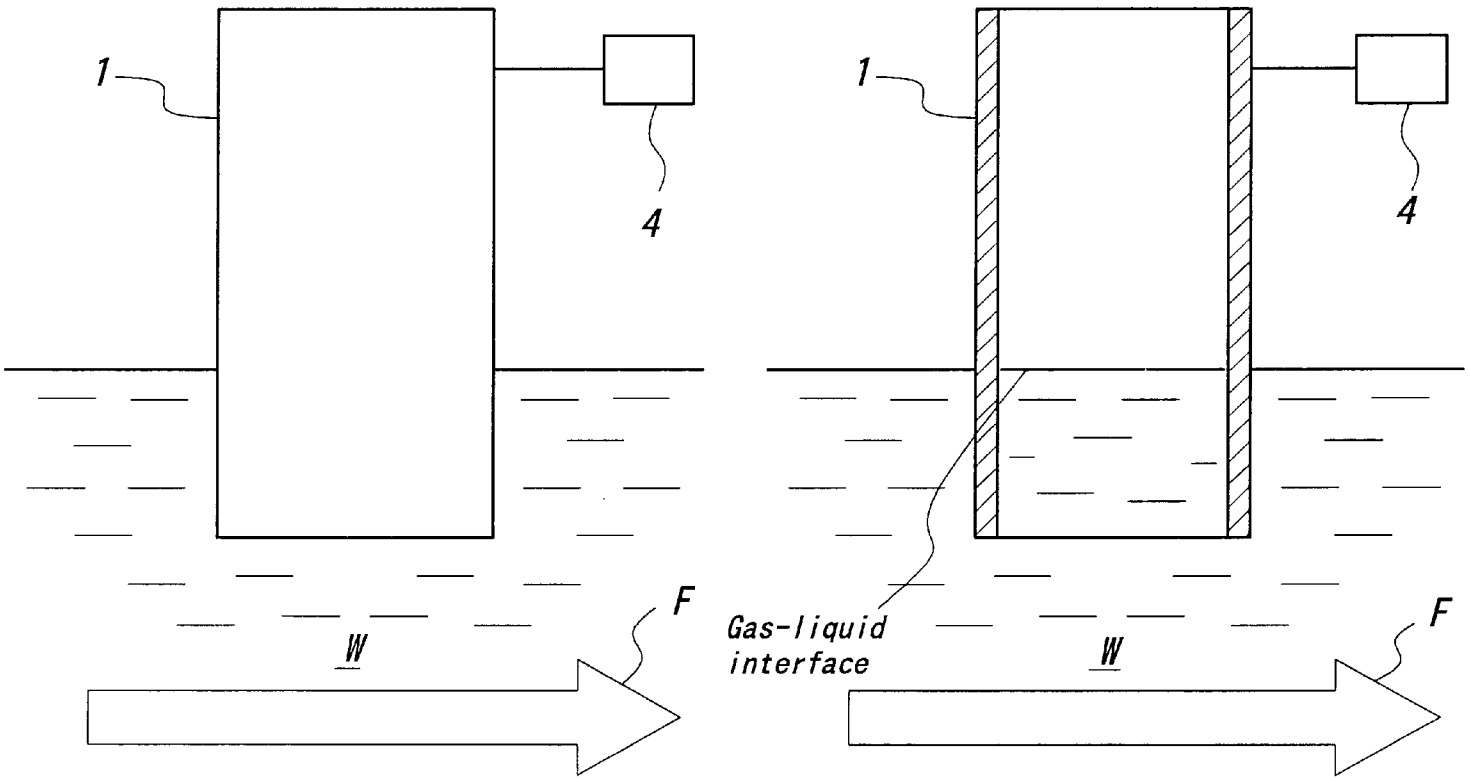
FIG. 1(*a*) is a side view of an embodiment of the supercooled liquid-freezing apparatus according to the present invention which is immersed in supercooled liquid, and FIG. 1(*b*) a sectional view of the same.

FIG. 1(*a*) is a side view of schematically illustrating an embodiment of the supercooled liquid-freezing apparatus according to the present invention which is immersed in supercooled liquid, and FIG. 1(*b*) a sectional view of the same. A supercooled liquid W circulates or flows in a circulating channel or a flowing channel (not shown) in a flow direction F. A main part of the supercooled liquid-freezing apparatus is immersed in the supercooled liquid W. In FIGS. 1(*a*) and 1(*b*), a container 1 is of a tubular shape with an upper end and a bottom end opened. The interior of the container connects with the supercooled liquid outside the apparatus through the bottom opening. The supercooled liquid enters the container, and a gas-liquid interface is formed between a gas such as air in an upper portion inside the container. In FIGS. 1(*a*) and 1(*b*), a reference numeral 4 denotes an oscillator schematically illustrated for applying vibration to the supercooled liquid. As the oscillator, a known device including a oscillating means may be used. Vibration may be also applied to the container by hand without using the oscillator.

Figure 2B:
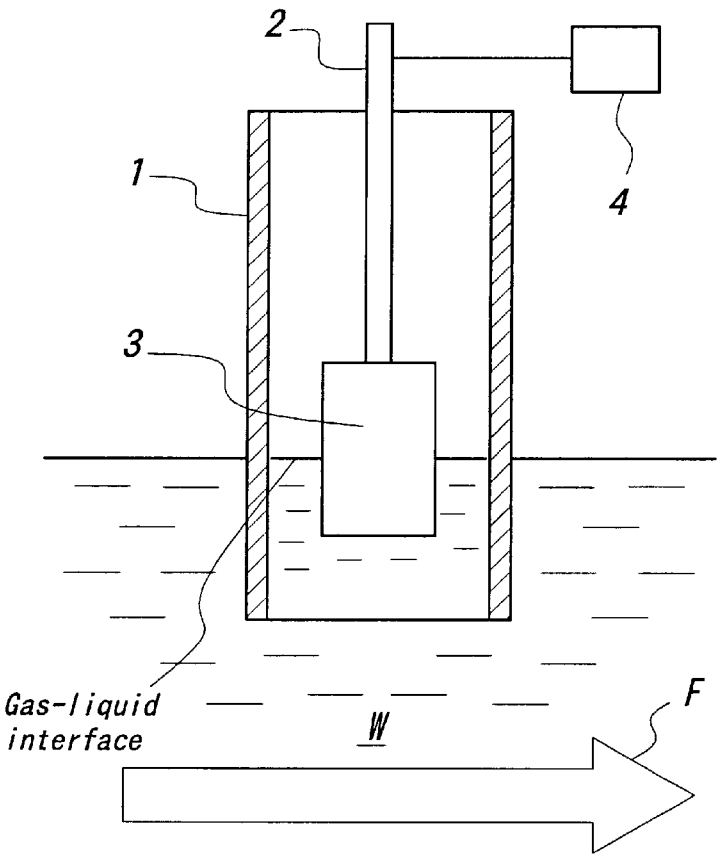
FIG. 2(*a*) is a side view of another embodiment of the supercooled liquid-freezing apparatus according to the present invention which is immersed in supercooled liquid, and FIG. 2(*b*) a sectional view of the same.
Figure 2A:
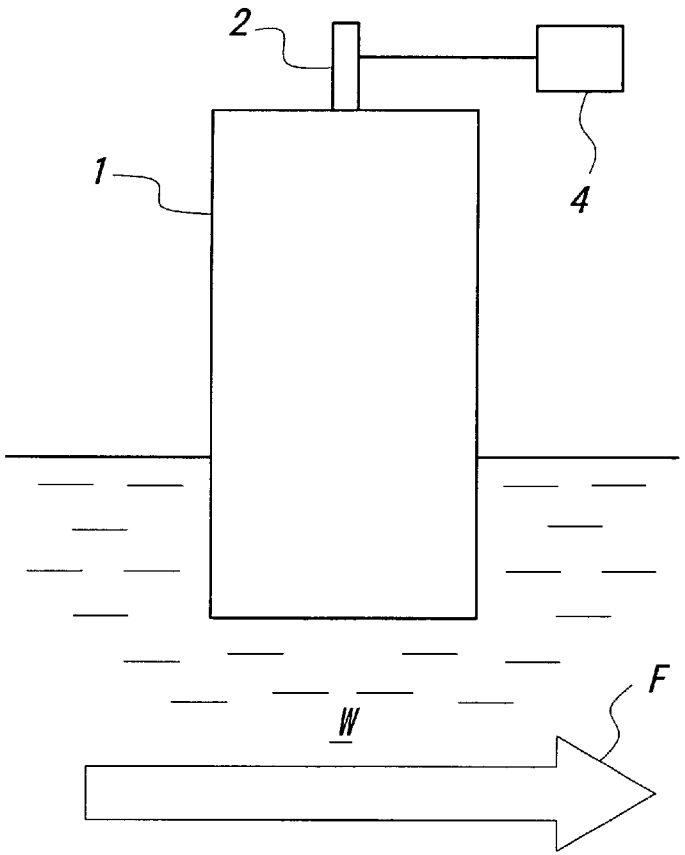

FIG. 2(*a*) is a side view of schematically illustrating another embodiment of the supercooled liquid-freezing apparatus according to the present invention which is immersed in supercooled liquid, and FIG. 2(*b*) a sectional view of the same. A supercooled liquid W circulates or flows in a circulating channel or a flowing channel (not shown) in a flow direction F. A main part of the supercooled liquid-freezing apparatus is immersed in the supercooled liquid W. In FIGS. 2(*a*) and 2(*b*), a container 1 is of a tubular shape with an upper end and a bottom end opened. A reference numeral 2 denotes a supporting rod, and a vibrating rod-shaped member 3 is attached to an end of the supporting rod 2. The outer diameter of the rod-shaped member 3 is slightly smaller than the inner diameter of the container. The interior of the container connects with the supercooled liquid outside the apparatus through the bottom opening. The supercooled liquid enters the container, and a gas-liquid interface is formed between a gas such as air in an upper portion inside the container. In FIGS. 2(*a*) and 2(*b*), a reference numeral 4 denotes an oscillator schematically illustrated for applying vibration to the supercooled liquid. As the oscillator, a known device including a oscillating means may be used. Vibration may be also applied to the container by hand without using the oscillator.

Figure 3:
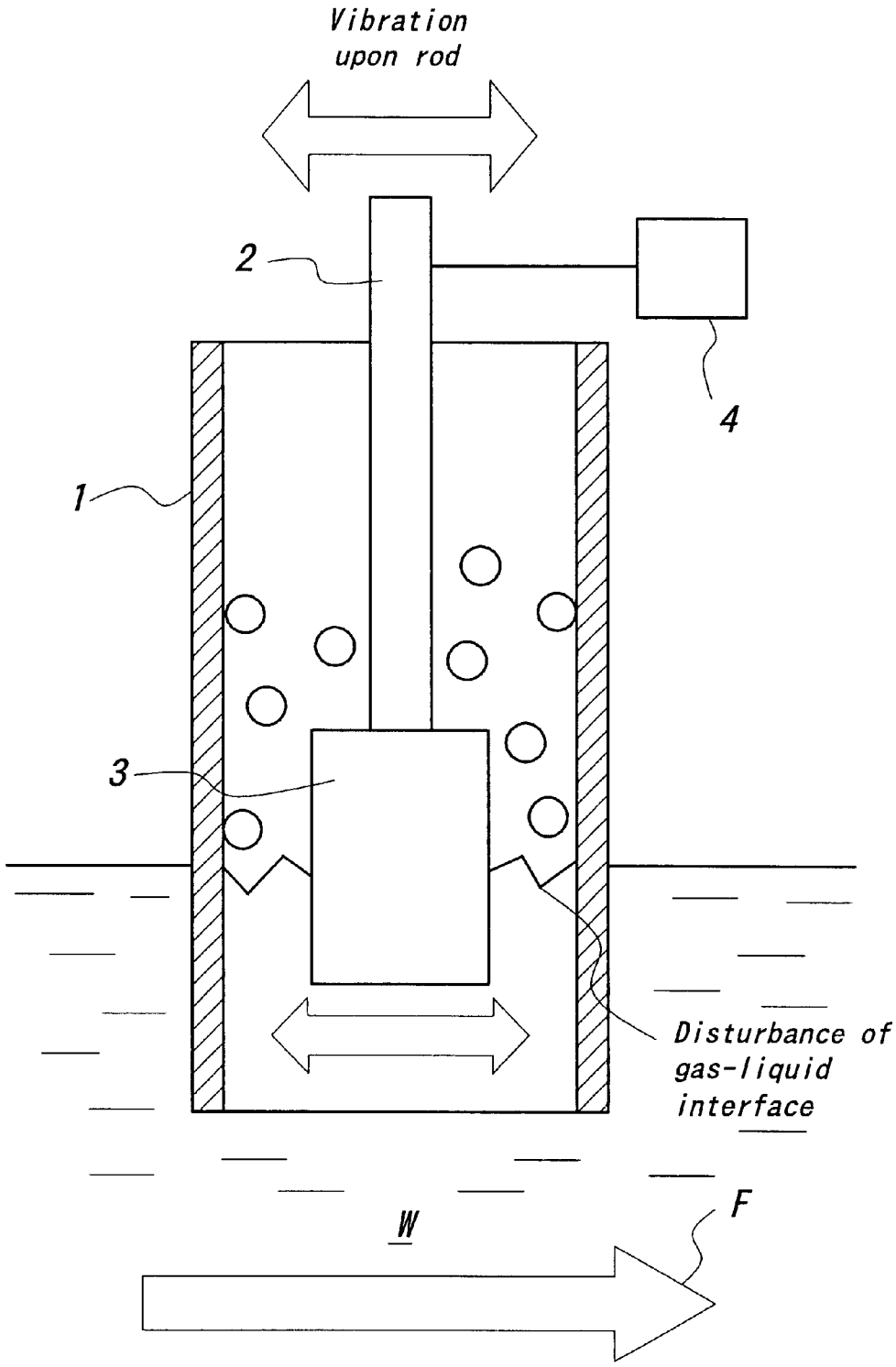
FIG. 3 is a sectional view for schematically illustrating a step of mixing bubbles into the supercooled liquid by using the freezing apparatus in FIGS. 2(*a*) and 2(*b*).
Figure 4:
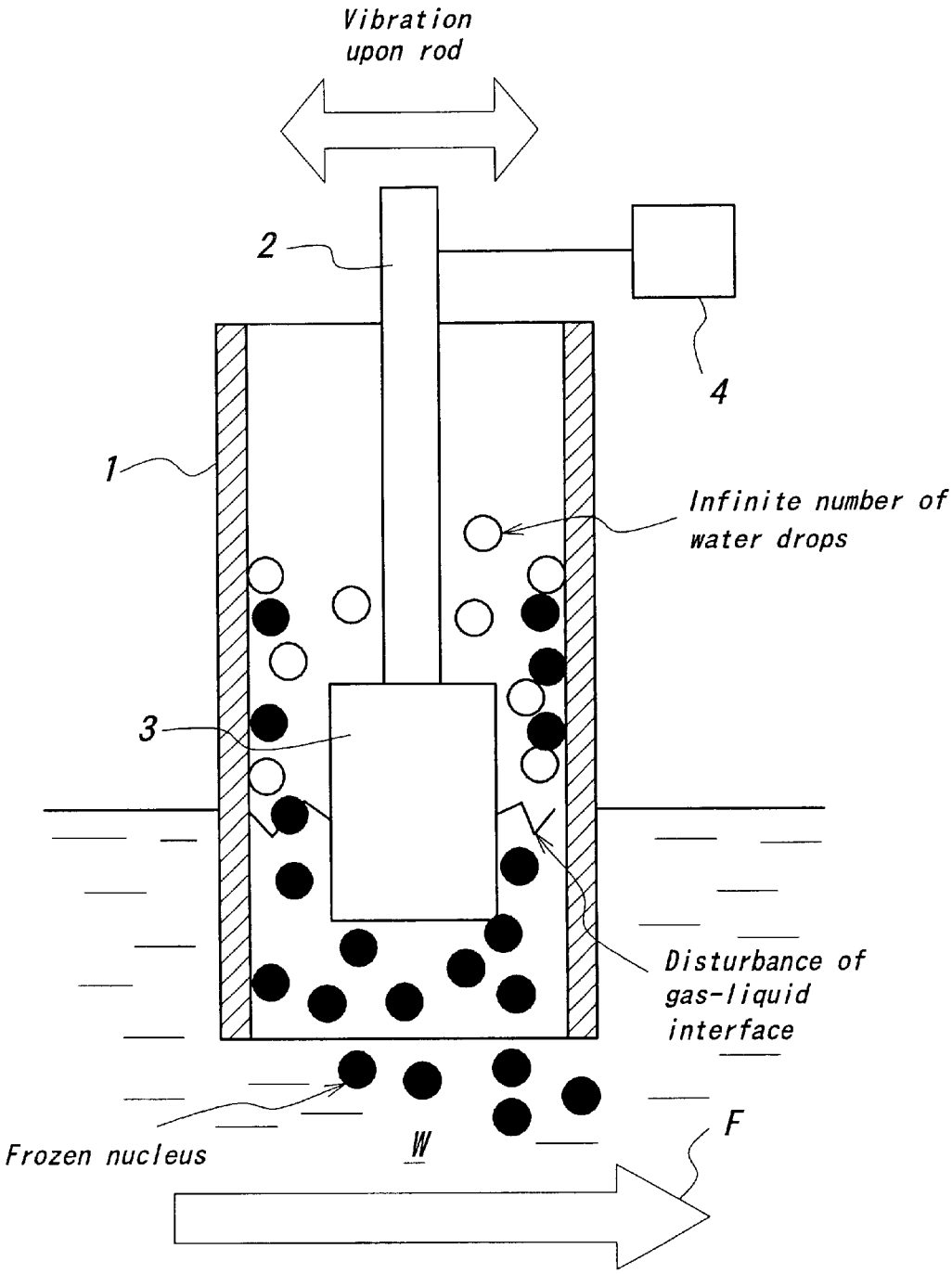
FIG. 4 is a sectional view for schematically illustrating a step of discharging the supercooled liquid a part of which is released from the supercooled state in the freezing apparatus of FIGS. 2(*a*) and 2(*b*) outside the container.

FIG. 3 is a sectional view for illustrating a state of mixing bubbles into the supercooled liquid and forming freezing nuclei (in case of the supercooled liquid) by using the freezing apparatus in FIGS. 2(*a*) and 2(*b*). FIG. 4 is a sectional view for schematically illustrating a state of discharging the supercooled liquid a part of which is released from the supercooled state in the freezing apparatus of FIGS. 2(*a*) and 2(*b*) into the supercooled liquid outside the container.

As shown in FIG. 3, the oscillator 4 applies vibration at a low frequency (a frequency of 5~10/second, for example) to the rod-shaped member 3 through the rod 2, and the rod-shaped member 3 is continuously hit upon the tubular body 1. Thereby, the gas-liquid interface is vigorously oscillated, splash waves of the supercooled liquid are formed above the gas-liquid interface, and scattered liquid drops of the supercooled liquid are formed. As a result, an infinite number of bubbles and the liquid drops enter the supercooled liquid through the gas-liquid interface. Such a phenomenon is repeatedly provoked, so that the supercooled state of the supercooled liquid is released, and freezing nuclei are formed in the liquid drops and the supercooled liquid inside the container.

FIG. 4 illustrates the state of discharging the thus formed freezing nuclei into the supercooled liquid outside the apparatus through the bottom opening of the tubular body. The discharged liquid containing the freezing nuclei freezes the supercooled liquid located downstream outside the tubular body in a chain-like manner. By the above operation, the freezing nuclei are continuously flown into the supercooled liquid in a surrounding area, thereby enabling the freezing thereof. On the other hand, as the freezing nuclei flows out, fresh supercooled liquid enters the tubular body.

In this embodiment, although the supercooled liquid-flowing severe case is contemplated, but the apparatus according to the present invention does not require that the supercooled liquid flow. Needless to say, the invention apparatus can be applied to the stationary supercooled liquid.

EXAMPLE 1

Figure 5:
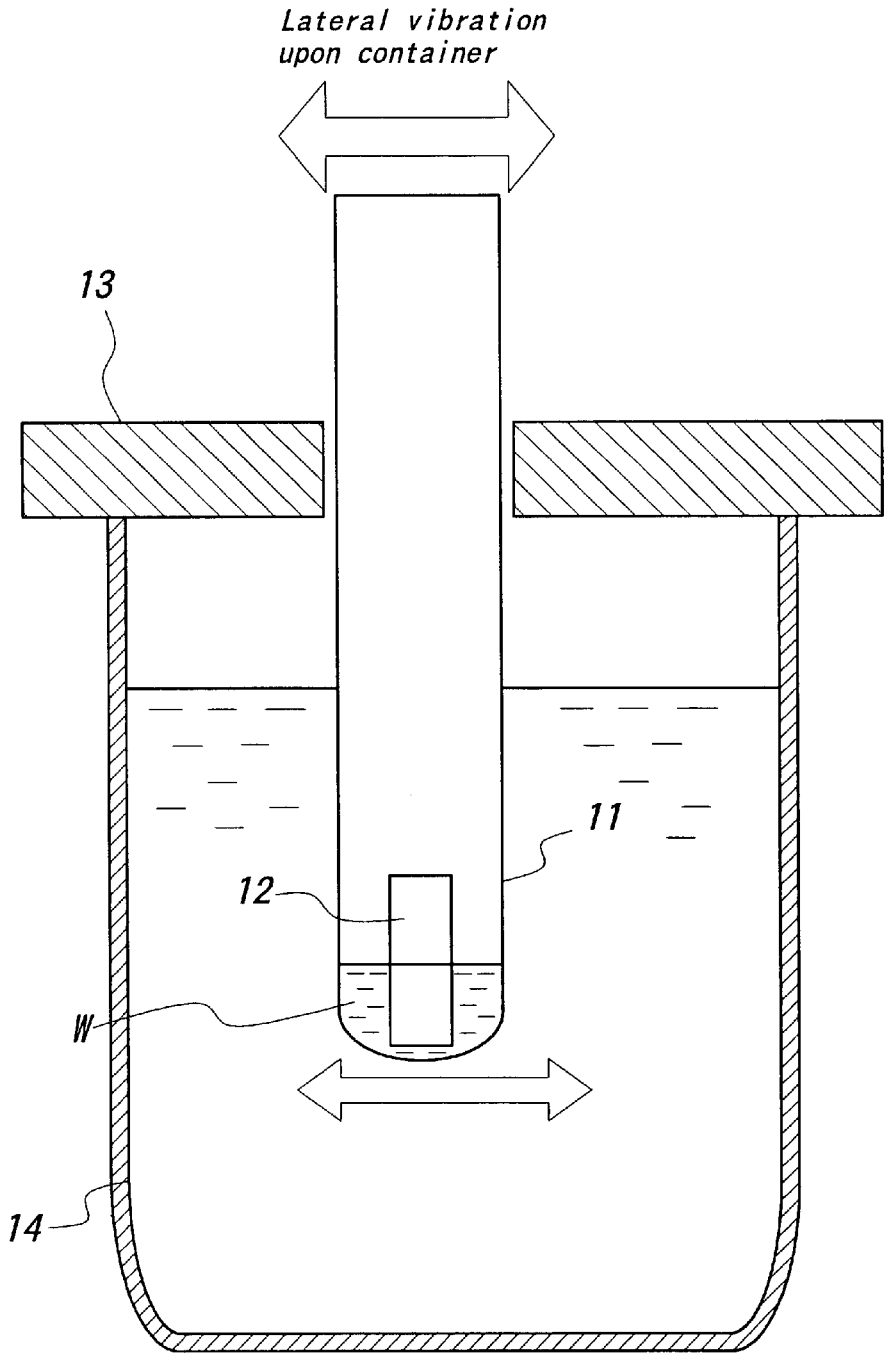
FIG. 5 is a sectional side view of a tester for examining effects of the freezing apparatus according to the present invention.

A supercooled liquid-freezing test apparatus shown in FIG. 5 was prepared as a simple embodiment of the supercooled liquid-freezing apparatus shown in FIGS. 1 to 4. Experiments were conducted to confirm effects of the present invention. A polypropylene test tube 11 was used as a container, a round rod 12 made of Teflon (R) was placed into the container. The round rod had an outer diameter and a length smaller than the inner diameter and the length of the container, respectively. Super pure water was poured into the container such that the lower portion of the round rod was located under a gas-liquid interface.

Next, a plate having an opening with a size allowing insertion of the container was prepared. The container 11 was inserted through the plate 13 so that the container might be immersed into a coolant inside a supercooled bath 14. The super pure water sample was cooled by the above apparatus, and kept at a constant temperature slightly lower than 0° C., thereby forming a supercooled state.

Vibration was applied at a relatively low frequency upon the container by hand (for example, at 5 to 10 vibrations/second) for a few to a dozen seconds. Thereby, the round rod was vigorously contacted with the inner wall of the container. Thus, the supercooled water inside the container was stirred, splashed waves are formed and liquid drops were scattered. Then, an infinite number of the liquid drops of the supercooled water were continuously crashed upon the inner wall of the container, so that the infinite number of the bubbles were mixed into the supercooled water.

Figure 6:
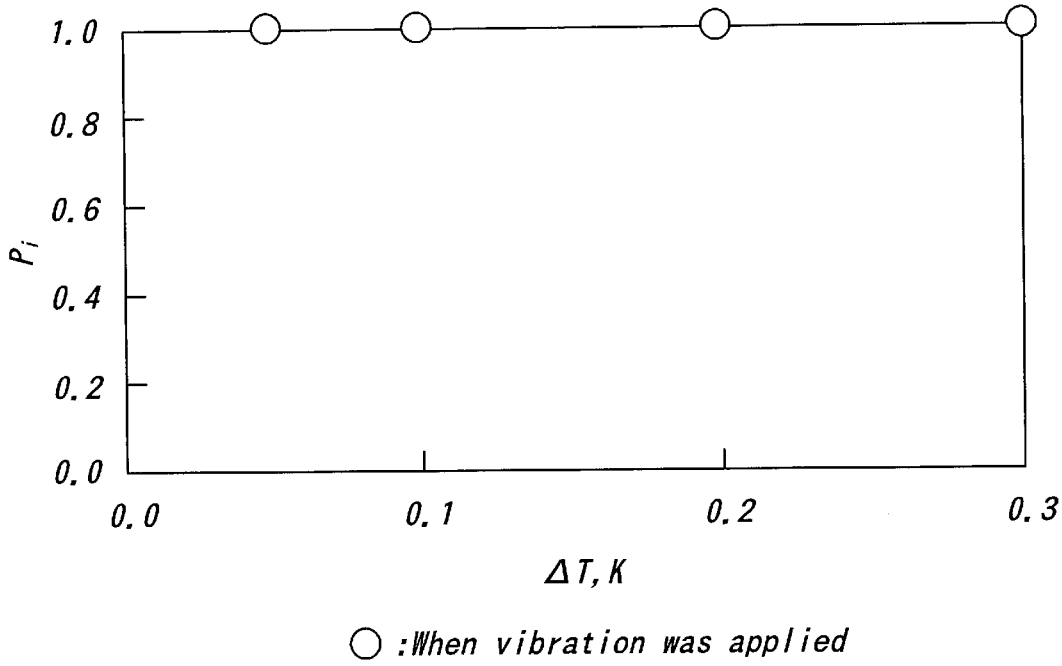
FIG. 6 is a graph showing experimental results when using the tester shown in FIG. 5.

FIG. 6 shows the relationship between the absolute figure $\Delta T$ (the supercooled degree) of the difference between the freezing temperature and 0° C. and the frozen probability Pi. FIG. 6 gives the frozen probabilities when the supercooled was kept at the supercooled degree $\Delta T$=0.05 K, 0.1 K, 0.2 K or 0.3 K. It is seen that the supercooled liquid was frozen at 100% at each temperature. The frozen probability is given by (number of times of freezing in the experiment)/(number of entire actual trials in the experiment)×100 (%). On the other hand, in the case where no vibration was applied to the container, the average $\Delta T$ was not less than about 20 K.

In order to enhance the freezing effect in this experiment, the round rod was inserted. When vibration was applied to the container without inserting the round rod thereinto, the supercooled liquid was frozen at a temperature higher than −1.0° C. Further, when the same experiment was effected in each of a 5%-ethylene glycol aqueous solution and a 10%-ethylene glycol aqueous solution, the supercooled solution was frozen at near the freezing point.

From the above, it is seen that the freezing nuclei begins to be formed by the operation of stirring the supercooled liquid or supercooled solution, forming the splashed waves, scattering liquid drops, continuously crashing a infinite number of the liquid drops of the supercooled liquid or solution of the inner wall of the container and mixing such liquid drops into thereinto.

From the above, according to the present invention, the supercooled liquid at such a low supercooled state can be instantly frozen at any time through positively eliminating the supercooled state with the smaller apparatus as compared with the prior art. In addition, since a number of such downsized apparatuses can be easily installed in the supercooled liquid or moved therein, the supercooler liquid can be frozen at any place. Therefore, when the freezing apparatus according to the present invention is used as a supercooled state-eliminating apparatus for an ice thermal storage system, for example, the freezing load of the freezer can be largely reduced, which can greatly contribute to the energy storage field, the freezing air conditioning field and the environmental field.

What is claimed is:

1. A method for freezing a supercooled liquid, comprising the steps of forming a liquid phase of a supercooled liquid and a gas phase adjacent to said liquid phase in a container, vibrating a gas-liquid interface formed by said liquid phase and said gas phase by applying vibration upon the gas-liquid interface and/or a vicinity thereof along the gas-liquid interface, forming splashed waves of the supercooled liquid, scattering liquid drops of the supercooled liquid, crashing the liquid drops upon a portion of an inner wall of said container where the gas phase is located, mixing resulting liquid drops and bubbles into the supercooled liquid through the gas-liquid interface, subjecting said bubbles mixed in the supercooled liquid to expansion, compression, disruption, clustering and disappearance, thereby vigorously oscillating the gas-liquid interface and freezing the supercooled liquid.

2. The supercooled liquid-freezing method set forth in claim 1, wherein an oscillator is immersed into said liquid phase inside the container, and the vibration is applied upon the gas-liquid interface formed by the liquid phase and the gas phase by said oscillator.

3. A supercooled liquid-freezing apparatus comprising a container for forming a liquid phase of a supercooled liquid and a gas phase therein, and an oscillator for applying vibration upon a gas-liquid interface formed inside the container between the liquid phase and the gas phase and/or a vicinity thereof along the gas-liquid interface, whereby vibrating the gas-liquid interface by application of vibration with said oscillator, forming splashed waves of the supercooled liquid, scattering liquid drops of the supercooled liquid, crashing the liquid drops upon a portion of an inner wall of said container where the gas phase is located, mixing resulting liquid drops and bubbles into the supercooled liquid through the gas-liquid interface, subjecting said bubbles mixed in the supercooled liquid to expansion, compression, disruption, clustering and disappearance, thereby vigorously oscillating the gas-liquid interface and freezing the supercooled liquid.

4. The supercooled liquid-freezing apparatus set forth in claim 3, wherein said oscillator comprises an oscillator immersed into said liquid phase inside the container, and the vibration is applied upon the gas-liquid interface formed by the liquid phase and the gas phase and/or said vicinity thereof by said oscillator.

5. A method for circulating or flowing a supercooled liquid, comprising the steps of introducing at least a part of a circulating or flowing supercooled liquid into a container provided with a supercooled liquid inlet, forming a liquid phase of said supercooled liquid introduced and a gas phase adjacent to said liquid phase in said container, vibrating a gas-liquid interface formed by said liquid phase and said gas phase by applying vibration upon the gas-liquid interface and/or a vicinity thereof along the gas-liquid interface, forming splashed waves of the supercooled liquid, scattering liquid drops of the supercooled liquid, crashing the liquid drops upon a portion of an inner wall of said container where the gas phase is located, mixing resulting liquid drops and bubbles into the supercooled liquid through the gas-liquid interface, subjecting said bubbles mixed in the supercooled liquid to expansion, compression, disruption, clustering and disappearance, thereby vigorously oscillating the gas-liquid interface and freezing the supercooled liquid, returning the supercooled liquid at least a part of which is released from being supercooled into the circulating or flowing supercooled liquid, and circulating or flowing the resultant.

6. The supercooled liquid-circulating or flowing method set forth in claim 5, wherein an oscillator is immersed into said liquid phase inside the container, and the vibration is applied upon the gas-liquid interface formed by the liquid phase and the gas phase and/or said vicinity thereof along the gas-liquid interface by said oscillator.

7. A supercooled liquid-circulating or flowing system comprising means for circulating or flowing a supercooled liquid, a container provided with a supercooled liquid inlet and adapted for receiving at least a part of the circulating or flowing supercooled liquid and forming a liquid phase of a supercooled liquid and a gas phase therein, an oscillator for applying vibration upon a gas-liquid interface formed inside the container between the liquid phase and the gas phase and/or a vicinity thereof along the gas-liquid interface, whereby vibrating the gas-liquid interface by application of vibration with said oscillator, forming splashed waves of the supercooled liquid, scattering liquid drops of the supercooled liquid, crashing the liquid drops upon a portion of an inner wall of said container where the gas phase is located, mixing resulting liquid drops and bubbles into the supercooled liquid through the gas-liquid interface, subjecting said bubbles mixed in the supercooled liquid to expansion, compression, disruption, clustering and disappearance, thereby vigorously oscillating the gas-liquid interface and freezing the supercooled liquid, returning the supercooled liquid at least a part of which is released from being supercooled into the circulating or flowing supercooled liquid, and circulating or flowing the resultant.

8. The supercooled liquid-circulating or flowing set forth in claim 7, wherein said oscillator comprises an oscillator immersed into said liquid phase inside the container, and the vibration is applied upon the gas-liquid interface formed by the liquid phase and the gas phase and/or said vicinity thereof by said oscillator.

* * * * *